US006305983B1

(12) United States Patent
Harting et al.

(10) Patent No.: US 6,305,983 B1
(45) Date of Patent: Oct. 23, 2001

(54) SCREENED ELECTRICAL PLUG CONNECTOR

(75) Inventors: Dietmar Harting, Espelkamp; Günter Pape, Enger; Dieter Lüttermann, Lübbecke, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/383,450

(22) Filed: Aug. 26, 1999

(30) Foreign Application Priority Data

Sep. 4, 1998 (DE) ..... 198 40 413

(51) Int. Cl.[7] ..... H01R 13/648
(52) U.S. Cl. ..... 439/607; 439/341
(58) Field of Search ..... 439/607–610, 439/83, 341, 345, 79

(56) References Cited

U.S. PATENT DOCUMENTS

| | | | |
|---|---|---|---|
| 4,968,261 | | 11/1990 | Mizunuma . |
| 5,030,140 | | 7/1991 | Sugiyama . |
| 5,104,341 | | 4/1992 | Gilissen et al. . |
| 5,281,169 | | 1/1994 | Kiat et al. . |
| 5,336,098 | | 8/1994 | Zell et al. . |
| 5,401,192 | | 3/1995 | Briones et al. . |
| 6,120,323 | * | 9/2000 | Zhung et al. ..... 439/567 |

FOREIGN PATENT DOCUMENTS

| | | |
|---|---|---|
| 0 458 483 A1 | 11/1991 | (EP) . |
| 0 834 964 A1 | 8/1998 | (EP) . |
| 2-146497 U | 12/1990 | (JP) . |
| 4-106853 U | 9/1992 | (JP) . |
| 4-135176 U | 12/1992 | (JP) . |

* cited by examiner

*Primary Examiner*—Khiem Nguyen
(74) *Attorney, Agent, or Firm*—Cook, Alex, McFarron, Manzo, Cummings & Mehler, Ltd.

(57) ABSTRACT

A screened electrical plug connector for surface mounting on printed circuit boards, consisting of an insulating plug housing (1), in which electrical connection elements are arranged, which are provided for making contact with contacts of a complementary plug connector, with terminals for connection to printed conductors of a printed circuit board, wherein at least one side of the plug housing is provided with a screening plate (2) that has a contact edge (6) for making contact with grounded printed conductors (13) of a printed circuit board (12), is characterised in that the screening plate (2) has a retaining edge (30; 32) opposite the contact edge (6), for attachment to the plug housing (1), and that the screening plate (2) is locked to the plug housing (1) at a distance from the retaining edge (30; 32).

26 Claims, 6 Drawing Sheets

SCREENED ELECTRICAL PLUG CONNECTOR

Figure 1:
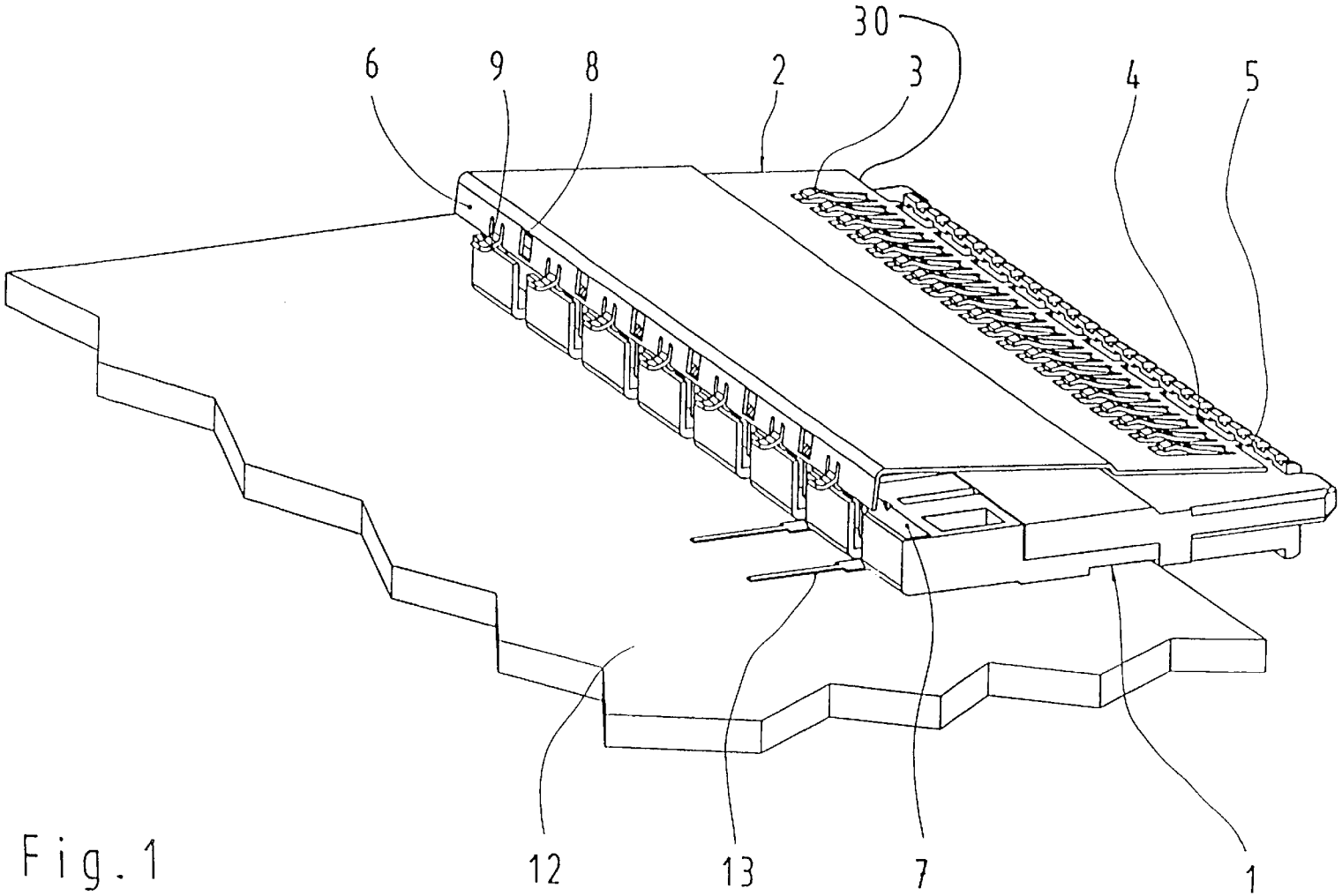

The invention concerns a screened electrical plug connector for surface mounting on printed circuit boards, consisting of an insulating plug housing, in which electrical connection elements are arranged, which are provided for making contact with contacts of a complementary plug connector, with terminals for connection to printed conductors of a printed circuit board, wherein at least one side of the plug housing is provided with a screening plate that has a contact edge for making contact with grounded printed conductors of a printed circuit board.

The screening of electrical plug-and-socket connections is necessary for improvement of the transmission power levels (HF characteristics) as well as for extensive reduction of particular interference signals such as those from external sources.

The screening of surface-mounted plug connectors is very cumbersome. It is in fact not possible to solder a screened SMD plug connector in a soldering plant for surface soldering technology. The thermal radiation that is needed for soldering the contacts would be reflected by the screening. Consequently, during the handling of SMD plug connectors it is first necessary to position the plug connector without its screening on a printed circuit board by means of a printed circuit board assembly machine and to solder the completely assembled printed circuit board in a further operating process. Only after this is the screening fitted and soldered in an additional manual or mechanical operating step.

A board edge connector that is not intended for surface mounting, but is press-fitted into the printed circuit board together with the screening plate using a conventional press-fit technique, is disclosed by DE 196 40 847 A1. For this purpose the screening plate is fitted with a press-fit contact pin that has to be press-fitted into the printed circuit board with which contact is to be made. In this way the screening plate is permanently connected on one side to the printed circuit board. On the opposite side the screening plate is inserted in undercut form into the plug housing.

The object of the invention is to develop a plug connector of the type described at the outset, to the effect that a screening plate is provided on the plug connector and can be connected to grounded printed conductors of a printed circuit board without the cumbersome soldering or press-fitting processes being necessary.

This object is achieved with a screened electrical plug connection of the type described at the outset, in that the screening plate has a retaining edge opposite the contact edge for attachment to the plug housing, and that the screening plate is locked to the plug housing at a distance from the retaining edge. The screening plate is thus no longer soldered to the printed circuit board, but is retained at the plug housing on the one hand by means of the retaining edge and on the other hand by being locked at a distance from the retaining edge. The screening plate can be simply clipped to the plug housing in this manner. Contact with the grounded printed conductors of the printed circuit board is achieved automatically when the screening plate is snapped into its final position on the plug housing, either by the contact edge coming directly into contact with the grounded printed conductors of the printed circuit board, or with contact parts that are connected to the printed conductors.

According to one embodiment of the invention, the screening plate is inserted into pockets in the plug housing at one side of the retaining edge and locked at the side of the contact edge by means of openings in the housing, that are formed in the contact edge, which is bent through 90°, and engage the locking hooks that are provided in the plug housing, preferably in a pocket. The contact edge can be fitted either with spring contact lugs which make direct contact with the grounded printed conductors of the printed circuit board, or, according to a different embodiment, the contact edge can also engage contact elements that are in electrical contact with the earthed printed conductors of the printed circuit board.

According to another embodiment of the invention, the screening plate is provided with a folded edge which encloses the side of the plug housing that is provided to accept a complementary plug connector, and is locked to the plug housing by means of locking lugs in the region of the opposite side of the plug housing. The contact edge has cut-outs which engage screening contacts which were, for example, soldered to the grounded printed conductors at the same time as the plug connector was soldered.

All types of embodiment offer the advantage that several variants of a screened plug connector can be adapted to the conditions of the printed circuit board economically and in a simple and problem-free manner.

A further advantage is that, optionally, either a single-sided or multi-sided screening plate can be employed, in which case the screening plate can be merely pushed on and makes contact with the printed circuit board via suitable contact elements.

Advantageous developments of the invention are stated in the sub-claims.

Figure 2:
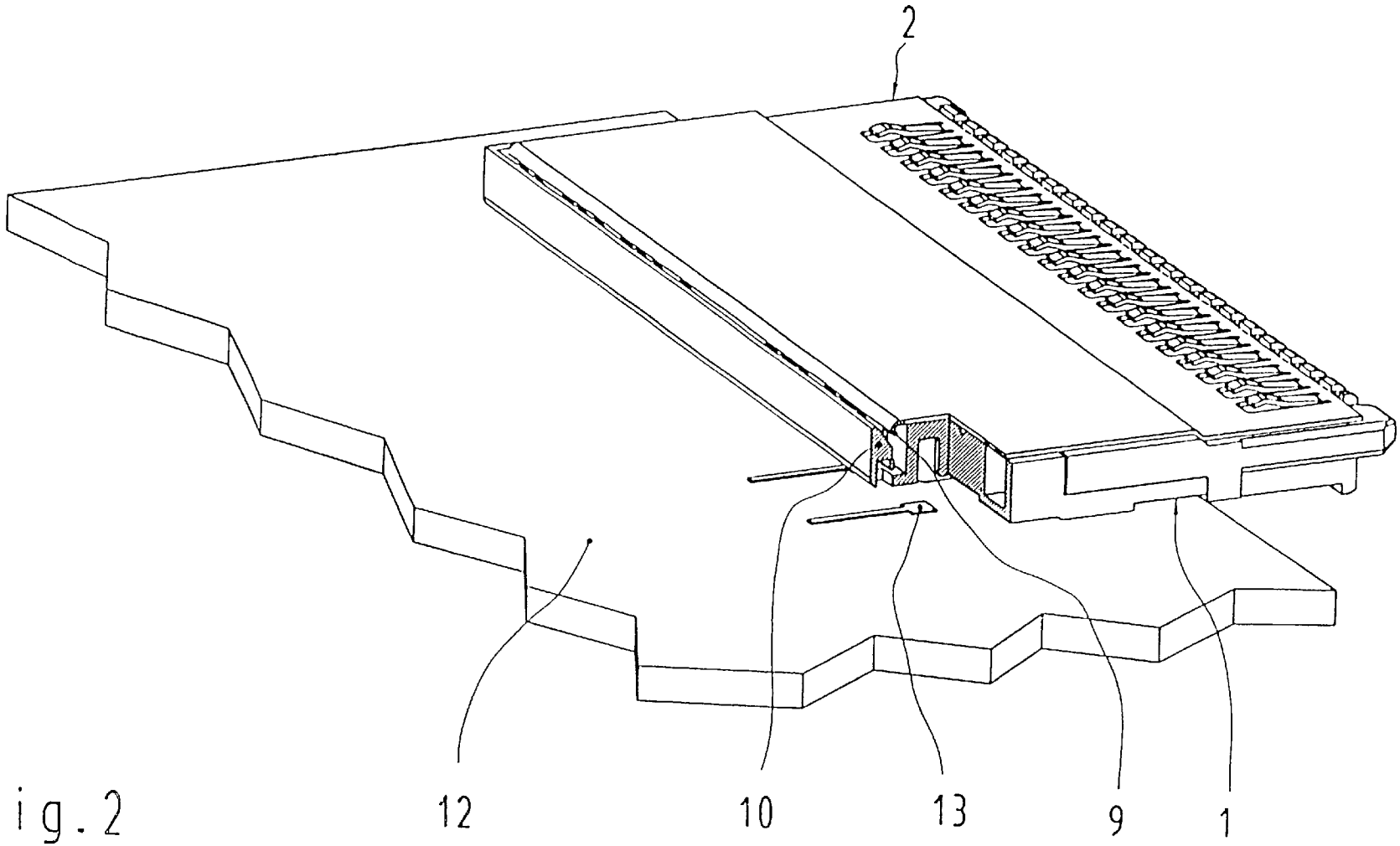
Figure 3:
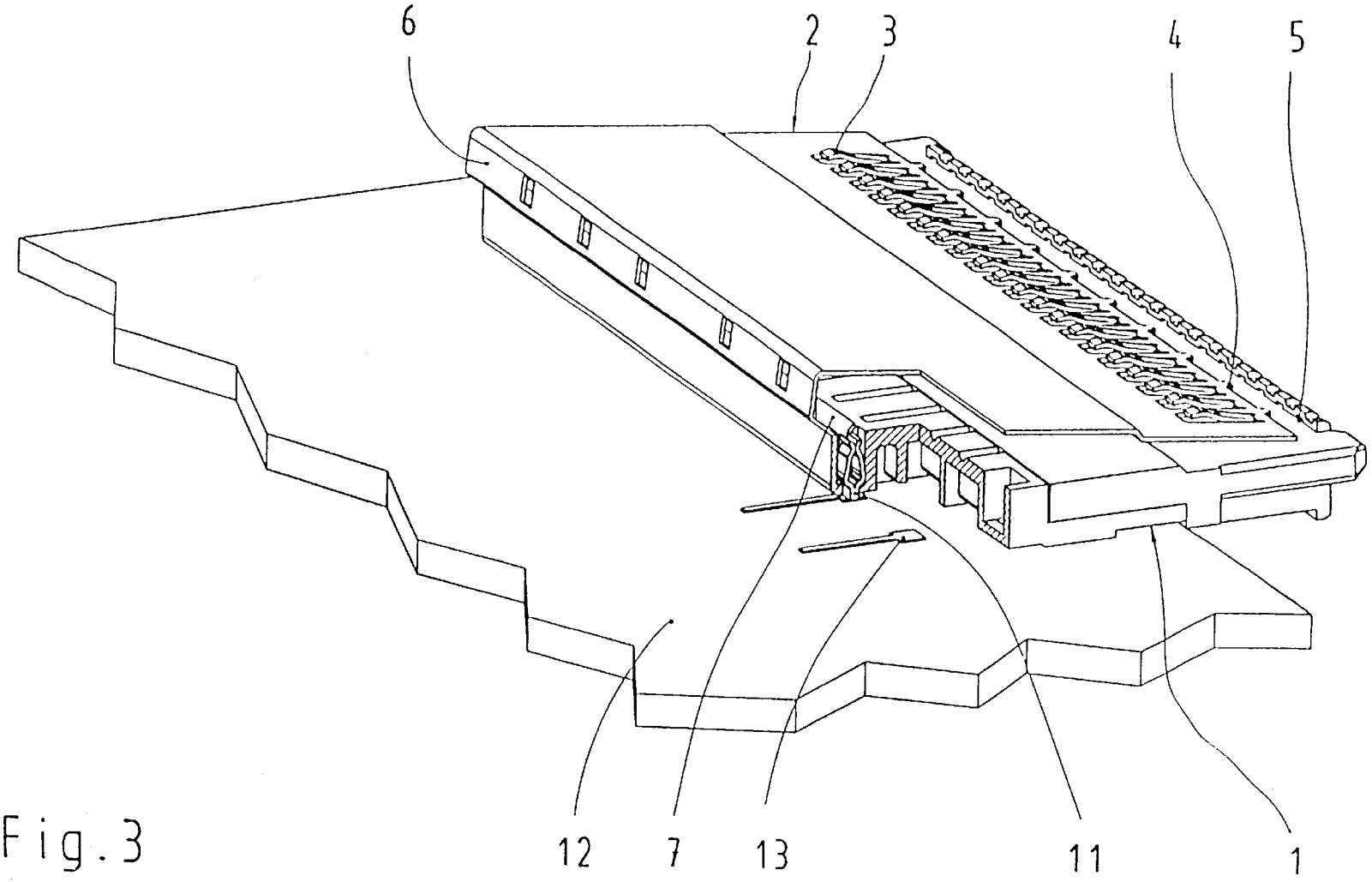
Figure 4:
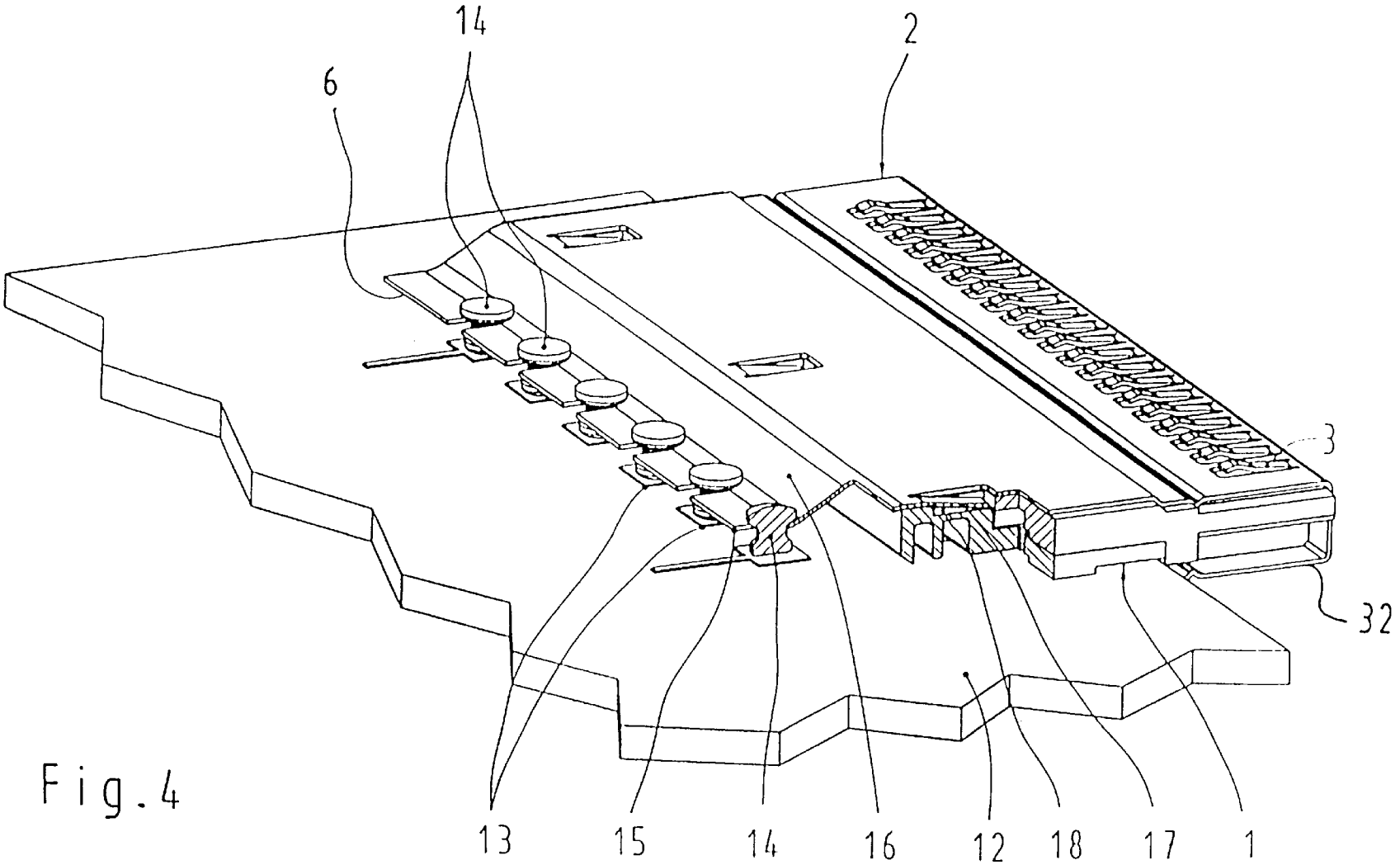
Figure 5:
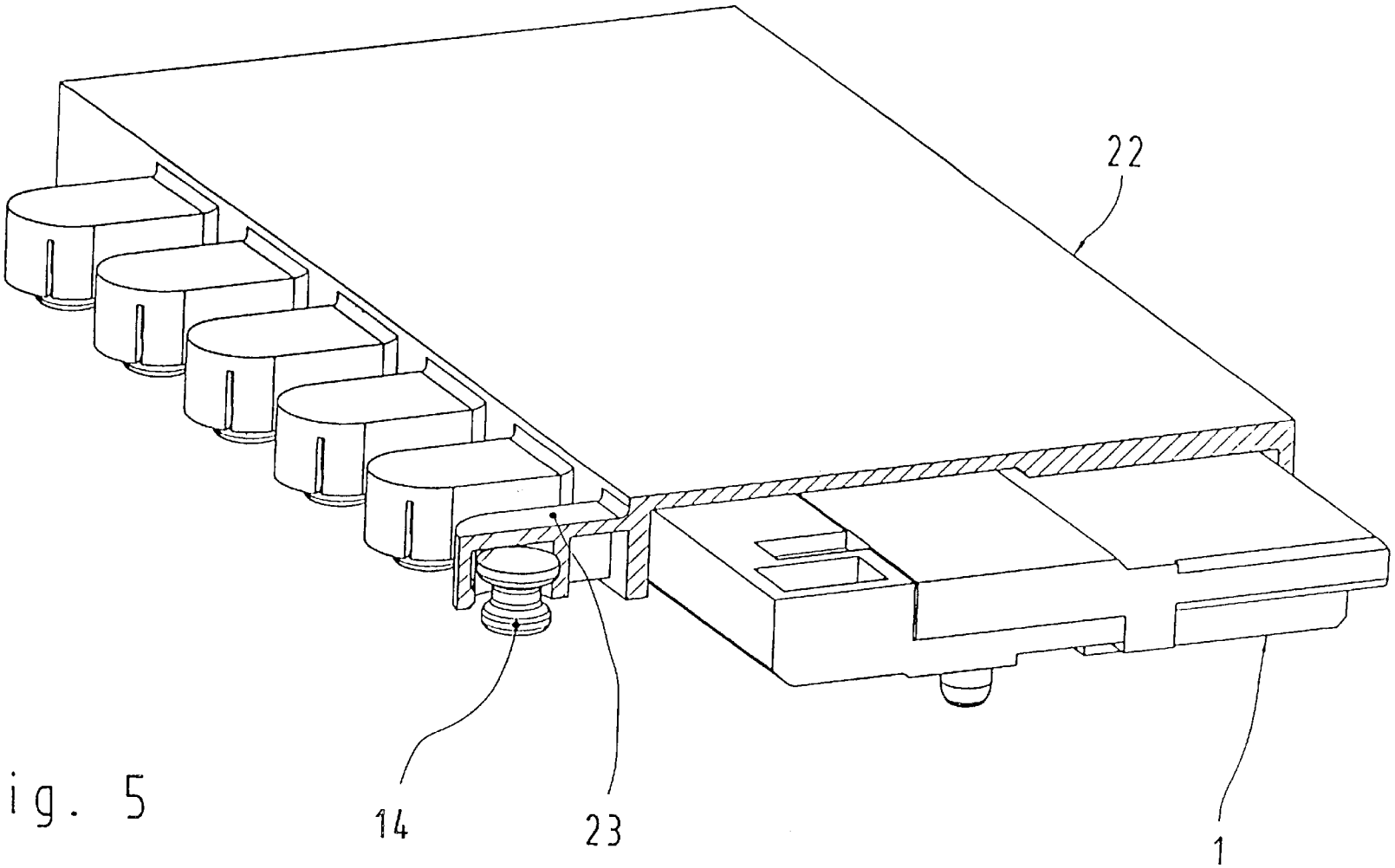
Figure 6:
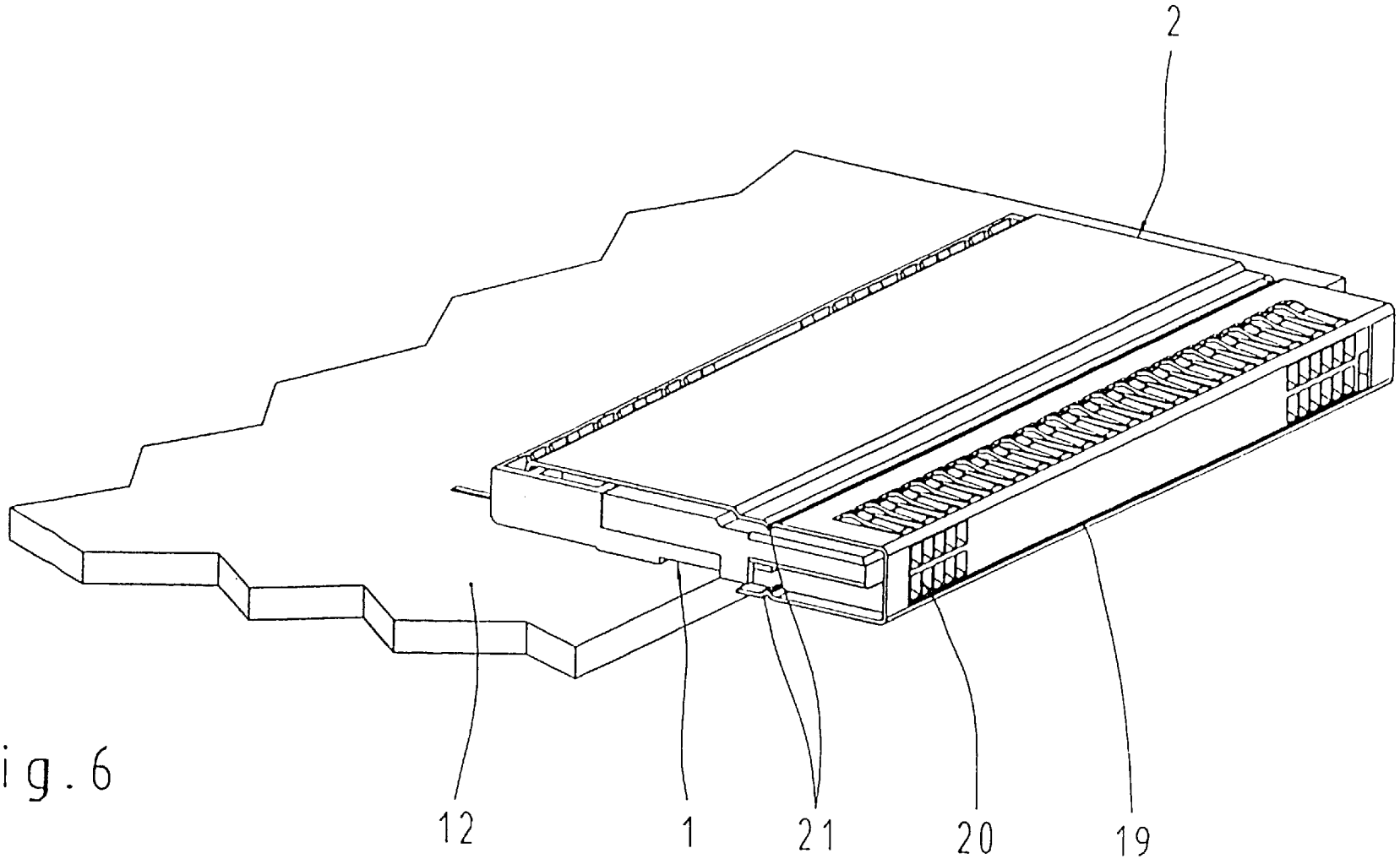

The invention is described below with reference to various embodiments that are illustrated in the drawings, of which FIG. 1 shows a perspective representation of a plug connector according to a first embodiment with a single-sided screening plate prior to being locked into position, FIG. 2 shows a perspective representation of the completed plug connector according to FIG. 1, FIG. 3 shows a perspective representation of a plug connector according to a different embodiment with a modified single-sided screening plate prior to being locked into position, FIG. 4 shows a perspective representation of a plug connector according to a further embodiment with a multi-sided screening plate, FIG. 5 shows a perspective representation of the assembly of a plug connector according to FIG. 4, with screening contacts arranged outside the plug housing, FIG. 6 shows a perspective representation of a plug connector according to a further embodiment, in a front view with a multi-sided screening plate.

FIGS. 1 and 2 show a plug connector that consists of an insulating plug housing 1, and resting on top of it a screening plate 2 fitted with contact tabs 3 that provide an grounded contact with a complementary plug. At the front side of the screening plate 2, which forms a retaining edge 30, one or more mounting fingers 4 are provided which engage suitably designed pockets 5 of the plug housing. The rear of the screening plate has a right-angled folded edge 6 which forms a contact edge and in which cut-outs 8 are formed, which, when the folded edge is inserted into a longitudinal chamber 7, are locked by means of the locking hooks 10 located at that point. The spring contact lugs 9 also attached to the folded edge 6 establish the contact with grounded printed conductors 13 on a printed circuit board 12.

A plug connector according to a different embodiment is shown in FIG. 3. Similar to the first embodiment, this plug connector consists of an insulating plug housing 1, as well as a screening plate 2 resting on top, that is provided with contact tabs 3 which provide an grounded contact to a complementary plug. At the front side of the screening plate are provided one or more mounting fingers 4 which engage with suitably designed pockets 5 of the plug housing, while the rear has a right-angled folded edge 6 in which the cut-outs 8 are inserted, which are locked by means of the locking hooks 10 when the folded edge 6 is inserted into the longitudinal chamber 7.

The contact between the screening plate 2 and the earthed printed conductor 13 on the printed circuit board 12 is provided via contact elements 11 which are permanently located in the longitudinal chamber 7 and can be constructed with one or two legs, in which case the contact elements can be mounted individually or interconnected as contact rails.

FIG. 4 shows a plug connector according to a further embodiment, which illustrates a further screening option for the plug connector. As a retaining edge, the screening plate 2 has a turn-over 32 which is pushed over the insulating plug housing 1 from the front. At the contact edge 6 the screening plate is provided with a number of cut-outs 15 which engage under screening contacts 14. A spring cross-over area 16 is provided between the contact edge 6 and the screening plate, so as to ensure a secure connection between the screening plate 2 and the screening contacts 14.

The screening plate 2 has additional spring locking lugs 17 which lock into corresponding recesses 18 in the plug housing 1 when the screening plate is pushed on, which ensures that the screening plate 2 cannot be detached without auxiliary means.

FIG. 5 illustrates the plug housing 1 of the plug connector of FIG. 4 with screening contacts in a mounting cap. In the rear part of the mounting cap 22 are located several receiver pockets 23 that are fitted with individual screening contacts 14. The mounting cap 22 with plug housing 1 and the screening contacts 14 is positioned on the printed circuit board by a printed circuit board assembly machine and removed again after the soldering process.

FIG. 6 illustrates a plug connector according to a further embodiment, which combines the components of the plug connector shown in FIGS. 1 and 2 with those of the plug connector shown in FIG. 4. The insulating plug housing 1 has a multi-sided screening plate 2 with a turn-over, a window-type opening 19 being cut in the front area of the plug 20, into which the signal contacts of a complementary plug connector can be inserted. Flexing of the screening plate is prevented by stamping a bead 21 in the lower and upper part of the screening plate. The screening plate is provided with a folded edge that is locked into a chamber on the side of the plug housing facing away from the front side.

What is claimed is:

1. A screened electrical plug connector for surface mounting on printed circuit boards, having an insulating plug housing (1), in which electrical connection elements are arranged, which are provided for making contact with contacts of a complementary plug connector, with terminals for connection to printed conductors of a printed circuit board, wherein at least one side of the plug housing is provided with a screened plate (2) that has a contact edge (6) for making contact with grounded printed conductors (13) of a printed circuit board (12), characterized in that the screening plate (2) has a retaining edge (30; 32) opposite the contact edge (6), for attachment to the plug housing (1), and the screening plate (2) is locked to one of the plug housing (1) or the printed circuit board (12) at a pluralitv of points along the contact edge (6).

2. The screened electrical plug connector according to claim 1, characterized in that the retaining edge (30) is provided with mounting fingers (4) that are inserted in pockets (5) on the plug housing (1).

3. The screened electrical plug connector according to claim 1, characterized in that the retaining edge is constructed as a turn-over (32), which encloses the corresponding side of the plug housing (1).

4. The screened electrical plug connector according to claim 3, characterized in that the region of the contact elements of the plug housing (1) the turn-over (32) is provided with a window-type opening (19).

5. The screened electrical plug connector according to claim 3 characterized in that the screening plate (2) is provided with locking lugs (17) that are snapped into recesses (18) of the plug housing (1).

6. The screened electrical plug connector according to claim 1 characterized in that the contact edge is constructed as a folded edge (6) in which the cut-outs (8) are provided, by means of which the folded edge (6) is snapped into the plug housing (1) in a direction that is perpendicular to the printed circuit board (12).

7. The screened electrical plug connector according to claim 6, characterized in that locking hooks (10) are constructed on the plug housing (1), which engage with the cut-outs (8) in the folded edge (6).

8. The screened electrical plug connector according to claim 6 characterized in that the folded edge (6) is provided with spring contact lugs (9) for making contact with the Grounded [earthed] printed conductors (13).

9. The screened electrical plug connector according to claim 6 characterized in that the folded edge (6) engages with at least one contact element (11) that makes contact with the grounded printed conductors (13).

10. The screened electrical plug connector according to claim 6 in that the folded edge (6) engages with a chamber (7) on the plug housing.

11. The screened electrical plug connector according to claim 1 characterized in that the contact edge (6) is provided with a plurality of cut-outs (15) intended to engage with screening contacts (14) soldered to the grounded printed conductors (13), and that the contact edge (6) is connected to the remainder of the screening plate (2) by means of a spring-loaded cross-over area (16).

12. The screened electrical plug connector according to claim 11, characterized in that the screening contacts (14) are constructed as rotationally symmetric contacts, as stamped contacts or electrically-conducting plastic contacts.

13. The screened electrical plug connector according claim 11, characterized in that the screening plate is provided with spring contact tabs (3).

14. A screened electrical plug connector for surface mounting on printed circuit boards having an insulating plug housing, in which electrical connection elements are arranged, which are provided for making contact with contacts of a complementary plug connector, with terminals for connection to printed conductors of a printed circuit board, at least one side of the plug housing being provided with a screening plate that has a contact edge for making contact with grounded printed conductors of a printed circuit board, the contact edge (6) having a plurality of cut-outs (15) intended to engage with screening contacts (14) soldered to the grounded printed conductors (13), the cut-outs being engageable with the screening contacts on one side thereof and the printed circuit board on the other side such that the contact edge is secured to the printed circuit board, and the contact edge (6) being connected to the remainder of the screening plate (2) by means of a spring-loaded cross-over area (16).

15. The screened electrical plug connector according to claim 14, characterized in that the retaining edge is constructed as a turn-over (32), which encloses the corresponding side of the plug housing (1).

16. The screened electrical plug connector according to claim 15, characterized in that the region of the contact elements of the plug housing (1) the turn-over (32) is provided with a window-type opening (19).

17. The screened electrical plug connector according to claim 14, characterized in that the screening contacts (14) are constructed as rotationally symmetrical contacts, as stamped contacts or electrically-conducting plastic contacts.

18. The screened electrical plug connector according claim 14, characterized in that the screening plate is provided with spring contact tabs (3).

19. A screened electrical plug connector for surface mounting on printed circuit boards, having an insulating plug housing (1), in which electrical connection elements are arranged, which are provided for making contact with contacts of a complementary plug connector, with terminals for connection to printed conductors of a printed circuit board, wherein at least one side of the plug housing is provided with a screened plate (2) that has a contact edge (6) for making contact with grounded printed conductors (13) of a printed circuit board (12), characterized in that the screening plate (2) has a retaining edge (30; 32) opposite the contact edge (6), for attachment to the plug housing (1), and the screening plate (2) is locked to the plug housing (1) along the contact edge, the contact edge having a folded edge and cutouts (8) which engage locking hooks (10) in the plug housing such that the folded edge is locked to the plug housing.

20. The screened electrical plug connector according to claim 19, characterized in that the retaining edge (30) is provided with mounting fingers (4) that are inserted in pockets (5) on the plug housing (1).

21. The screened electrical plug connector according to claim 19, characterized in that the retaining edge is constructed as a turn-over (32), which encloses the corresponding side of the plug housing (1).

22. The screened electrical plug connector according to claim 21, characterized in that the region of the contact elements of the plug housing (1) the turn-over (32) is provided with a window-type opening (19).

23. The screened electrical plug connector according to claim 21, characterized in that the screening plate (2) is provided with locking lugs (17) that are snapped into recesses (18) of the plug housing (1).

24. The screened electrical plug connector according to claim 19, characterized in that the folded edge (6) is provided with spring contact lugs (9) for making contact with the grounded printed conductors (13).

25. The screened electrical plug connector according to claim 19, characterized in that the folded edge (6) engages with at least one contact element (11) that makes contact with the grounded printed conductors (13).

26. The screened electrical plug connector according to claim 19 in that the folded edge (6) engages with a chamber (7) on the plug housing.

* * * * *